United States Patent [19]

Sando et al.

[11] 4,236,392

[45] Dec. 2, 1980

[54] CONTINUOUS PROCESSING APPARATUS FOR TREATMENT OF KNIT FABRIC MATERIAL

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 94,456

[22] Filed: Nov. 15, 1979

[30] Foreign Application Priority Data

Nov. 27, 1978 [JP] Japan ..... 53-146314

[51] Int. Cl.[3] ..... D06B 3/24

[52] U.S. Cl. ..... 68/5 E; 68/13 R

[58] Field of Search ..... 68/5 C, 5 D, 5 E, 13 R, 68/176, 183

[56] References Cited

U.S. PATENT DOCUMENTS 3,817,061 6/1974 Bruner ..... 68/5 D

FOREIGN PATENT DOCUMENTS 2840932 3/1979 Fed. Rep. of Germany ..... 68/5 E 51-18548 6/1976 Japan ..... 68/183

*Primary Examiner*—Philip R. Coe

*Attorney, Agent, or Firm*—Toren, McGeady and Stanger

[57] ABSTRACT

A continuous processing apparatus for treating a tubular knit fabric material through a high pressure steamer drum body. The steamer drum body contains a driving drum rotatably arranged in the middle part thereof; many fabric material receiving rolls arranged to guide the fabric material in a spiral manner within the steamer drum body; and a pot eye arranged close to a fabric material inlet of the steamer drum body to wring the fabric material into a rope-like shape. In the vicinity of a fabric material outlet of the steamer drum body, there are provided an air supply pipe which supplies air into the rope-like shape of the fabric material to swell it into a tubular shape; and a flattening device which is arranged to flatten and spread out the tubular fabric material in the direction of breadth thereof immediately before the material is guided to the outside of the apparatus.

1 Claim, 2 Drawing Figures

CONTINUOUS PROCESSING APPARATUS FOR TREATMENT OF KNIT FABRIC MATERIAL

BACKGROUND OF THE INVENTION

1. Field of the Invention

This invention relates to a continuous processing apparatus for treatment of a knit fabric material.

2. Description of the Prior Art

Conventional apparatuses for continuously processing a tubular knit fabric material for dyeing treatment, for example, or for preliminary treatment thereof required before dyeing treatment, are arranged without exception to have the knit fabric material continuously passed through a hygro-thermic treatment steamer in its open state, i.e. in a broad flattened state in carrying out the desired treatment. However, with a tubular fabric material flattened and guided from one guide roll to another within a hydro-thermic treatment steamer during a hygro-thermic treatment process, there are produced folding lines or crease marks on both sides of the flattened tubular knit fabric material and then the edge parts and the middle part of the fabric material cannot be evenly treated with a liquid or with humid heat. Thus, such uneven treatment has been degrading the quality of products obtained through such a treatment process.

Further, with hygro-thermic treatment carried out by allowing a flatly stretched-out tubular knit fabric material to pass through the steamer, the tubular knit fabric material accommodating capacity of the steamer decreases and, in order to allow the humid heat to adequately act on the fabric material, the size of the steamer must be increased to let it have a greater fabric material accommodating capacity. However, increase in the size of the hygro-thermic treatment steamer causes an increase in cost. Transportation and installation of it become not easy. Besides, the quantity of steam and that of a promotor to be used also increase. Therefore, increase in size of the steamer is not desirable in terms of saving resources and energy. The present invention is directed to the solution of these problems.

SUMMARY OF THE INVENTION

It is the first object of this invention to provide a continuous processing apparatus capable of allowing humid heat to sufficiently act on a tubular knit fabric material within a compact hydro-thermic treatment steamer, which facilitates transportion and installation thereof.

It is the second object of this invention to provide a continuous processing apparatus capable of continuously treating a tubular knit fabric material without producing any crease marks and any uneven results of treatment to obtain a high quality product.

These and further objects, features and advantages of the invention will become apparent from the following description of an embodiment thereof taken in connection with the accompanying drawings.

DETAILED DESCRIPTION OF PREFERRED EMBODIMENT

Figure 1:
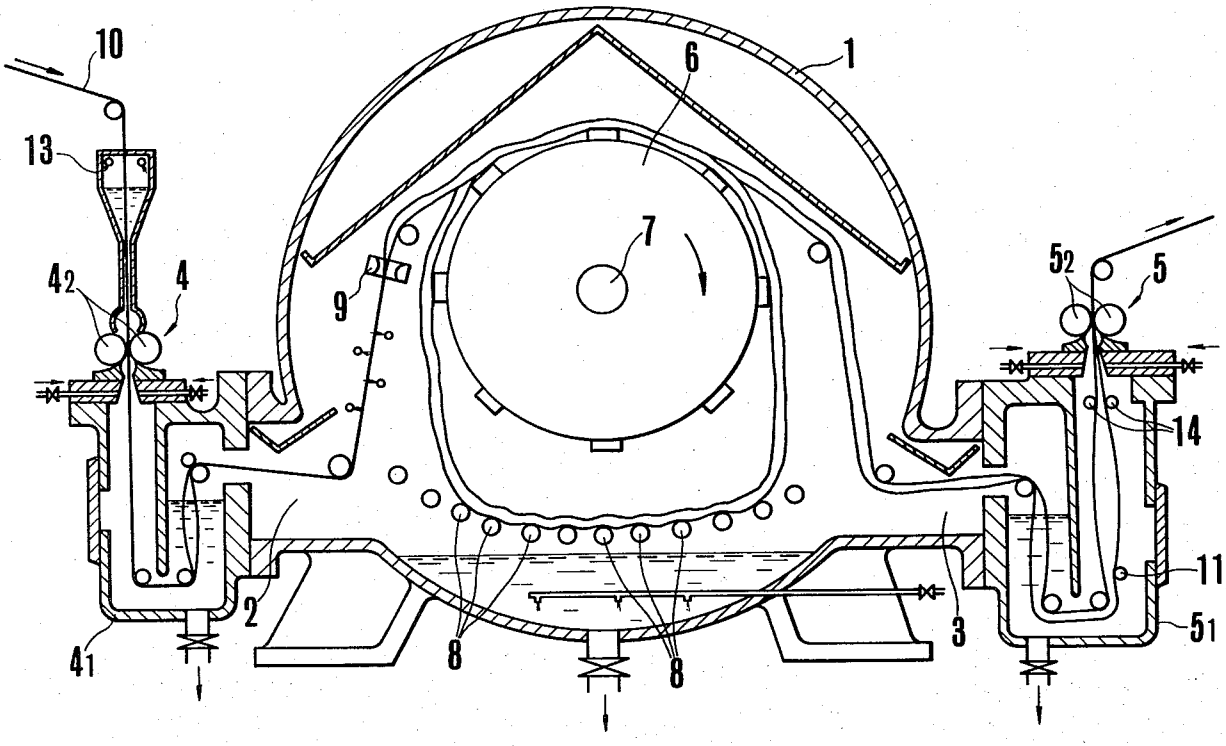
FIG. 1 is a sectional view showing a processing apparatus for continuously treating a knit fabric material as embodiment of the present invention.
Figure 2:
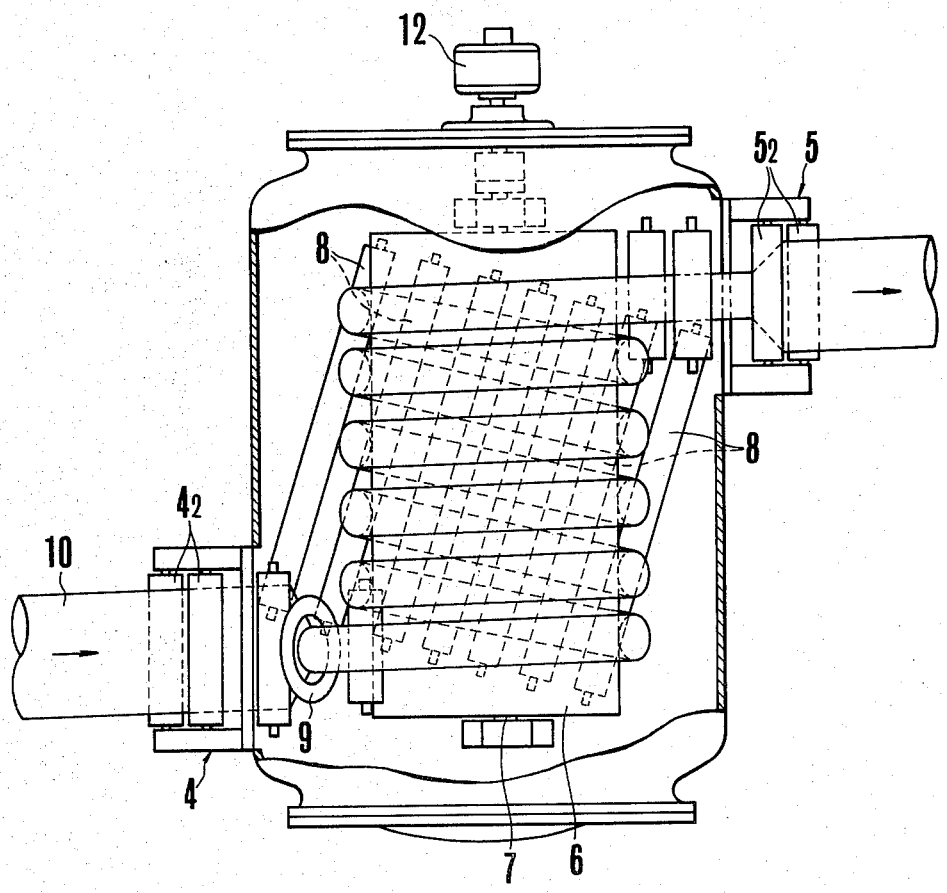
FIG. 2 is a plan view showing the same embodiment.

Referring to FIGS. 1 and 2 showing an embodiment of the invention, there is provided a steamer drum body 1 which is arranged to treat a tubular knit fabric material under high pressure humid heat. The steamer drum body presents an approximately circular shape in its front view and is provided with a fabric material inlet 2 and a fabric material outlet 3 which are formed on both sides thereof. The fabric material inlet and outlet 2 and 3 are provided with an inlet side seal mechanism 4 and an outlet side seal mechanism 5 each of which is arranged to have high pressure humid heat such as a saturated steam pressure of about 2 kg/cm$^2$ kept within the steamer drum body though each of them is arranged to permit the fabric material to pass therethrough. The inlet side seal mechanism 4 comprises a U-shaped passage $4_1$ which communicates with the fabric material inlet 2 and a pair of seal rubber rolls $4_2$ which are arranged to seal an external opening of the above stated passage $4_1$. Within the passage $4_1$, there is a liquid such as a caustic liquid or a dye solution. The outlet side seal mechanism 5 comprises a U-shaped passage $5_1$ which communicates with the fabric material outlet 3 and a pair of seal rubber rolls $5_2$ which are arranged to seal the external opening of the passage $5_1$. The passage $5_1$ is arranged to have water which is cooled down to temperature about 50° C. always circulate therethrough. However, these seal mechanism are not included in the subject matter of the present invention. The invention is not limited to the use of the seal mechanisms 4 and 5 and seal mechanisms may be selected out of the various seal mechanisms which have been developed by the inventors of the present invention. Therefore, further details of these seal mechanism are omitted from description herein. In the middle part of the inside of the steamer drum body 1, there is provided a drum 6 which is rotatably carried by a support shaft 7. Many fabric material receiving rolls 8 are obliquely arranged in parallel with each other beneath the drum 6. Within the steamer drum body 1, there is also provided a pot eye 9 which is arranged close to the fabric material inlet 2 in such a manner that a tubular knit fabric material 10 is guided by the drum 6 in a rope-like state with the tubular knit fabric material 10 allowed to pass through this pot eye 9. An air pressure supply pipe 11 is arranged in contact with the fabric material 10 to supply air into the fabric material while the fabric material is passing through the water contained within the passage $5_1$. There are also provided a motor 12 for driving the drum 6; and a liquid applying tank 13 which is disposed above the seal rubber rolls $4_2$ of the inlet side seal mechanism 4.

The embodiment of the invention which is arranged as described in the foregoing operates in the following manner: The tubular knit fabric material 10 is impregnated with a given liquid while it enters a liquid tank 13 and then passes through the passage $4_1$ of the inlet side seal mechanism. The tubular knit fabric material 10 which is thus impregnated with the liquid is supplied to the steamer drum body 1 which has saturated steam of temperature about 130° C. kept therein. Inside the steamer drum body 1, the tubular knit fabric material 10 is wrung by the pot eye 9 and then is guided to the drum 6 in a rope-like state. The rope-like fabric material 10 falls down off the drum 6 and is guided on the fabric material receiving rolls 8. The fabric material receiving rolls 8 are obliquely arranged in their plan view to have the position of the rope-like fabric material 10 deviate from them in the axial direction of the drum 6 such that the fabric material 10 is guided and conveyed on them in a spiral manner as the drum 6 rotates. The portion of the fabric material 10 which has been guided and conveyed by the drum 6 is further guided to the outside through the liquid contained in the passage $5_1$ of the seal mechanism 5 provided on the side of the fabric material outlet. While passing through the inside of the liquid which is in the passage $5_1$, the tubular knit fabric material 10 which has come in the rope-like shape has air pressure supplied to the inside thereof from the air pressure supply pipe 11. Therefore, the tubular knit fabric material 10 is swollen by the air pressure into a tubular shape within the liquid in the passage $5_1$. Then, the swollen fabric material 10 is pushed into a flat, stretched shape by a pair of spreading bars before it is guided to the outside through the seal rubber rolls $5_2$ for a next process.

As described in the foregoing, during the hydro-thermic treatment carried out within the high pressure steamer, the tubular knit fabric material is wrung into a rope-like shape and is guided and conveyed in a spiral manner, so that a large quantity of the fabric material can be placed within the high pressure steamer. Therefore, in accordance with the present invention, the fabric material can be subjected to a humid heat treatment to a sufficient degree with a compact high pressure steamer. Further, in accordance with this invention, the tubular knit fabric material is never caused to have fold lines at fixed positions, i.e. crease marks, and can be homogeneously treated with the humid heat, because the fabric material is conveyed in a rope-like state during the hygro-thermic treatment. Since the tubular knit fabric material is flattened and spread out immediately before it is guided to the outside, the sealing capability of the seal rubber rolls $5_2$ is never impaired and the fabric material can be transferred to a next process without any trouble.

The continuous processing apparatus of the present invention has the same hygro-thermic treatment capacity as a conventional steamer which is several times as large as the invented apparatus. Therefore, the continuous processing apparatus obtained in accordance with the invention excels in the economical aspect of the treatment process and contributes to reduction in cost.

What is claimed is:

1. A continuous processing apparatus for carrying out continuous hydro-thermic treatment of a tubular knit fabric material, said apparatus comprising:

a high pressure steamer drum body having a fabric material inlet, a middle part, and a fabric material outlet;

a driving drum rotatably disposed in said middle part;

a plurality of fabric material receiving rolls which are arranged beneath said driving drum to guide and convey said fabric material in a spiral manner around said driving drum;

a pot eye which is disposed close to said fabric material inlet, said pot eye being arranged to wring said tubular knit fabric material, which enters said pot eye in a flattened state, into a rope-like shape;

an air pressure supply means disposed close to said fabric material outlet, said air pressure supply means being arranged to supply air pressure to the inside of said rope-like shape of the fabric material to swell it into a tubular shape; and a fabric material flattening and spreading means which is disposed closer to said outlet than said air pressure supply means and is arranged to spread out said tubular knit fabric material into a flattened shape spreading in the direction of the breadth thereof.

* * * * *